US010837454B2

(12) United States Patent
Gausmann et al.

(10) Patent No.: US 10,837,454 B2
(45) Date of Patent: Nov. 17, 2020

(54) TURBOMACHINE

(71) Applicant: Siemens Aktiengesellschaft, Munich (DE)

(72) Inventors: Rainer Gausmann, Duisburg (DE); Chunsheng Wei, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/349,272

(22) PCT Filed: Oct. 26, 2017

(86) PCT No.: PCT/EP2017/077483
§ 371 (c)(1),
(2) Date: May 12, 2019

(87) PCT Pub. No.: WO2018/091250
PCT Pub. Date: May 24, 2018

(65) Prior Publication Data

US 2019/0264691 A1 Aug. 29, 2019

(30) Foreign Application Priority Data

Nov. 18, 2016 (DE) ..... 10 2016 222 786

(51) Int. Cl.
*F04D 29/053* (2006.01)
*F04D 1/12* (2006.01)
(Continued)

(52) U.S. Cl.
CPC ..... *F04D 29/053* (2013.01); *F04D 1/12* (2013.01); *F04D 5/00* (2013.01); *F04D 29/043* (2013.01);
(Continued)

(58) Field of Classification Search
CPC ..... F04D 1/12; F04D 29/047; F04D 29/628; F04D 29/057; F04D 29/624;
(Continued)

(56) References Cited

U.S. PATENT DOCUMENTS 2,885,963 A 5/1959 Ivanoff
4,586,872 A 5/1986 Corzilius et al.
(Continued)

FOREIGN PATENT DOCUMENTS

CN 1055804 A 10/1991
CN 1991190 A 7/2007
(Continued)

OTHER PUBLICATIONS

International search report and written opinion dated Feb. 19, 2018 for corresponding PCT/EP2017/077483.

*Primary Examiner* — Eldon T Brockman
(74) *Attorney, Agent, or Firm* — Wolter Vandyke Davis, PLLC

(57) ABSTRACT

A turbomachine having a rotor that extends along a rotational axis and a radial bearing in which the rotor is radially mounted on a radial bearing point. In the axial region of the radial bearing point, the rotor has a hollow chamber annularly located in the circumferential direction in the region of the outer 20% of the diameter of the radial bearing point and which is thermally insulating between a radially inner core region of the rotor in the region of the radial bearing point and the radial outer region of the rotor in the region of the radial bearing point. A first shaft end of the rotor protrudes from the axial center of the radial bearing point by a projection over the radial bearing point, wherein a first quotient QLO of the projection OVH divided by the total length TLE of the rotor QLO=OVH/TLE>0.15.

12 Claims, 2 Drawing Sheets

(51) Int. Cl.

| | |
|---|---|
| ***F04D 5/00*** | (2006.01) |
| ***F04D 29/046*** | (2006.01) |
| ***F04D 29/047*** | (2006.01) |
| ***F04D 29/62*** | (2006.01) |
| ***F04D 29/057*** | (2006.01) |
| ***F04D 29/056*** | (2006.01) |
| ***F04D 29/043*** | (2006.01) |
| ***F04D 29/58*** | (2006.01) |

(52) U.S. Cl.
CPC ..... *F04D 29/046* (2013.01); *F04D 29/047* (2013.01); *F04D 29/056* (2013.01); *F04D 29/057* (2013.01); *F04D 29/5853* (2013.01); *F04D 29/5893* (2013.01); *F04D 29/624* (2013.01); *F04D 29/628* (2013.01)

(58) Field of Classification Search
CPC .. F04D 29/056; F04D 29/043; F04D 29/5853; F04D 29/5893; F04D 29/053; F04D 5/00; F04D 29/046
See application file for complete search history.

(56) References Cited

U.S. PATENT DOCUMENTS

| | | | | |
|---|---|---|---|---|
| 4,971,459 | A | 11/1990 | McKenna | |
| 5,455,778 | A | 10/1995 | Ide et al. | |
| 6,353,272 | B1 * | 3/2002 | van der Hoeven ..... | F16C 17/02 310/261.1 |
| 9,835,196 | B2 * | 12/2017 | Baldassarre ..... | F16C 17/02 |
| 2007/0144833 | A1 | 6/2007 | Nii et al. | |
| 2009/0045582 | A1 | 2/2009 | De Larminat | |
| 2016/0084301 | A1 | 3/2016 | Baldassarre et al. | |

FOREIGN PATENT DOCUMENTS

| | | | |
|---|---|---|---|
| CN | 101765719 | A | 6/2010 |
| DE | 1528754 | A1 | 10/1970 |
| EP | 0983448 | B1 | 5/2009 |
| JP | S5931095 | U | 3/1984 |
| JP | S60143927 | U | 9/1985 |

* cited by examiner

TURBOMACHINE

CROSS REFERENCE TO RELATED APPLICATIONS

This application is the US National Stage of International Application No. PCT/EP2017/077483 filed Oct. 26, 2017, and claims the benefit thereof. The International Application claims the benefit of German Application No. DE10 2016 222 786.6 filed Nov. 18, 2016. All of the applications are incorporated by reference herein in their entirety.

FIELD OF INVENTION

The invention concerns a turbomachine, in particular a turbocompressor, comprising a rotor which is at least partly arranged in a casing and extends along a rotational axis, wherein the turbomachine has at least one radial bearing in which the rotor is radially mounted at a radial bearing point, wherein the radial bearing is designed as an oil-lubricated slide bearing, wherein in the axial region of the radial bearing point, the rotor has a cavity which is annularly located in a circumferential direction in the region of the outer 20% of the diameter of the radial bearing point of the rotor and which provides thermal insulation between a radially inner core region of the rotor in the region of the radial bearing point and the radially outer region of the rotor in the region of the radial bearing point.

BACKGROUND OF INVENTION

EP 983 448 B1 discloses a rotor shaft for turbomachines in which a thermally insulating cavity is provided in the region of a radial bearing.

It has been found that such a measure for avoiding the Morten effect is not equally useful in all turbomachines. The increase in diameter in the radial bearing region associated with this measure undesirably changes the rotor dynamics, without achieving positive improvements for the shaft strength to the same extent. The additional production complexity and the greater installation space required for the arrangement are also undesirable. However, in certain cases this measure is a very good possibility for improving the smooth running of the machine, achieving operating states which would not otherwise be possible, or also avoiding damage. In principle, the smooth running of the machine also has effects on the need for play at e.g. shaft seals and hence on their sealing capacity, so here too improvements in efficiency can be achieved.

SUMMARY OF INVENTION

The invention therefore faces the object of providing corresponding rotors of turbomachines with such thermal insulation at the bearing point when such a measure is useful.

To achieve this object, an arrangement of the type defined initially is proposed with the additional features of the characteristic part of the independent claim. The claims with back-references contain advantageous refinements of the invention.

Terms such as "radial", "axial", "tangential" or "circumferential" each refer to the axis of the rotor unless specified otherwise. The radial bearing according to the invention may also be configured as a combined radial and thrust bearing, and in any case serves to support static and dynamic radial bearing forces.

Since, according to the invention, a first shaft end of the rotor protrudes from the axial center of the radial bearing point by an overhang over the radial bearing point, wherein a first quotient of the overhang to a total length of the rotor is QLO=OVH/TLE>0.15, the quotient QLO is naturally always less than 1 because the overhang OVH cannot be greater than the total length TLE of the rotor. To this extent, this is not a unilaterally open interval, but an interval which is delimited at least logically and technically by an upper barrier of 1. In practice, in the sense of a suitable refinement, it is useful to assume 0.5>QLO=OVH/TLE>0.15.

The term "core region of the rotor" used by the invention refers to the region which is situated radially inwardly from the cavity according to the invention for thermal insulation. The core region is here the part of the rotor in the region of the radial bearing point which is essential for absorbing static and dynamic forces. The cavity in the region of the radial bearing point weakens the rotor cross-section, so the essential strength properties are determined by the core region.

An advantageous possible embodiment of the cavity lies in that a sleeve is applied to the rotor in the region of the radial bearing point, and a radially inner surface of said sleeve defines the cavity radially towards the outside. This sleeve may have a recess on the radially inner surface, and or be positioned via a corresponding recess on the rotor in the region of the radial bearing point, so that the cavity extends radially into the region of the sleeve and/or radially depletes the core region of the rotor.

A decisive teaching of the invention is based on the finding that it is particularly advantageous to equip a turbomachine with such a thermal insulation in the region of the radial bearing point if a first shaft end of the rotor protrudes from the axial center of the radial bearing point by an overhang over the radial bearing point, wherein a first quotient of this axial overhang to a total length of the rotor is greater than 0.15. This formula assumes that the main mass of the rotor is arranged on one side of the radial bearing point, and an overhang protrudes over the radial bearing point on the axially other side of the radial bearing point. On the side on which the greater mass proportion of the rotor is situated, a second radial bearing point or second radial bearing is also provided at a specific bearing spacing. The above situation with regard to the length ratio of total length to overhang can be expressed in an equation:

$$QLO=OVH/TLE>0.15$$

wherein

QLO: first quotient

OVH: overhang (in length unit, e.g. mm)

TLE: total length (in length unit, e.g. mm).

An advantageous refinement of the invention provides that the axial extent of the overhang of the rotor has an overhang mass, and the complete rotor has a total mass, wherein a quotient of the overhang mass to the total mass is >0.06. This situation can be expressed as follows in an equation:

$$QUT=OVM/TMS>0.06$$

wherein

QUT: second quotient

OVM: overhang mass (in kg)

TMS: total mass (in kg).

A further advantageous refinement of the invention provides that the radial bearing is configured such that a static bearing pressure is greater than 6 bar. It has been found that such an arrangement has a particular tendency to form the Morten effect.

It is particularly suitable to equip a turbomachine with the defined thermal insulation if the arrangement of rotor and radial bearing has a relative eccentricity of at least 0.1.

Here, the term "relative eccentricity" means the distance between the radial center axis of the radial bearing and the rotor axis at the bearing point, standardized to the radial play between the rotor and the slide bearing face of the radial bearing. The correlations are evident in FIG. 4 and explained in more detail below.

relative eccentricity $ecb=e/Cb$ (without dimension)

wherein

RAJ=radius of rotor at the bearing (averaged over axial extent)

RAB=radius of bearing relative to the slide faces (averaged over axial extent)

Cb=radial play between rotor and bearing=RAB-RAJ h=radial play as a function of circumferential position at which the play is measured hmin=MOFT: minimal oil-film play e=eccentricity: radial distance between the radial center of the bearing and the radial center of the rotor ecb=e/Cb=relative eccentricity: if zero, the rotor is centered in the bearing; if ecb reaches a value of 1, the rotor is touching the bearing so that the center of gravity of the rotor lies eccentrically to the rotor axis and consequently forms an imbalance.

A further advantageous refinement provides that the turbomachine is configured for a nominal operating state with a circumferential speed of >60 m/s at the outermost circumference of the bearing journal (portion of shaft or rotor in the region of the radial bearing). Here, the nominal operating state signifies the presence of the machine operating parameters with which operation takes place for the most time.

Particularly suitably, the radial bearing is configured as an isentropic mounting.

The invention is used particularly advantageously if the protruding first shaft end has a coupling, wherein the mass of the coupling is at least 2% of the total mass of the rotor. For such an arrangement, a measure against the Morten effect is extremely useful.

Particularly advantageous, the invention is used if the weight force of the overhang mass is at least 12% of the bearing load of the radial bearing. Furthermore, the use of the invention is particularly suitable if the overhang has a center of gravity which is situated closer to the axial end of the rotor than to the axial center point of the radial bearing.

Furthermore, use of the invention is particularly useful if the rotor is configured for nominal operation such that at nominal rotation speed, an imbalance centrifugal force of the overhang at 1° bend on the radial bearing amounts to at least 60% of the static bearing force in the radial bearing.

An advantageous refinement of the invention provides that a radial height of the cavity is less than 10%, advantageously less than 5% of the rotor diameter at the radial bearing position.

BRIEF DESCRIPTION OF THE DRAWINGS

The invention is explained in more detail below in relation to a particular exemplary embodiment with reference to drawings. The drawings show.

DETAILED DESCRIPTION OF INVENTION

Figure 1:
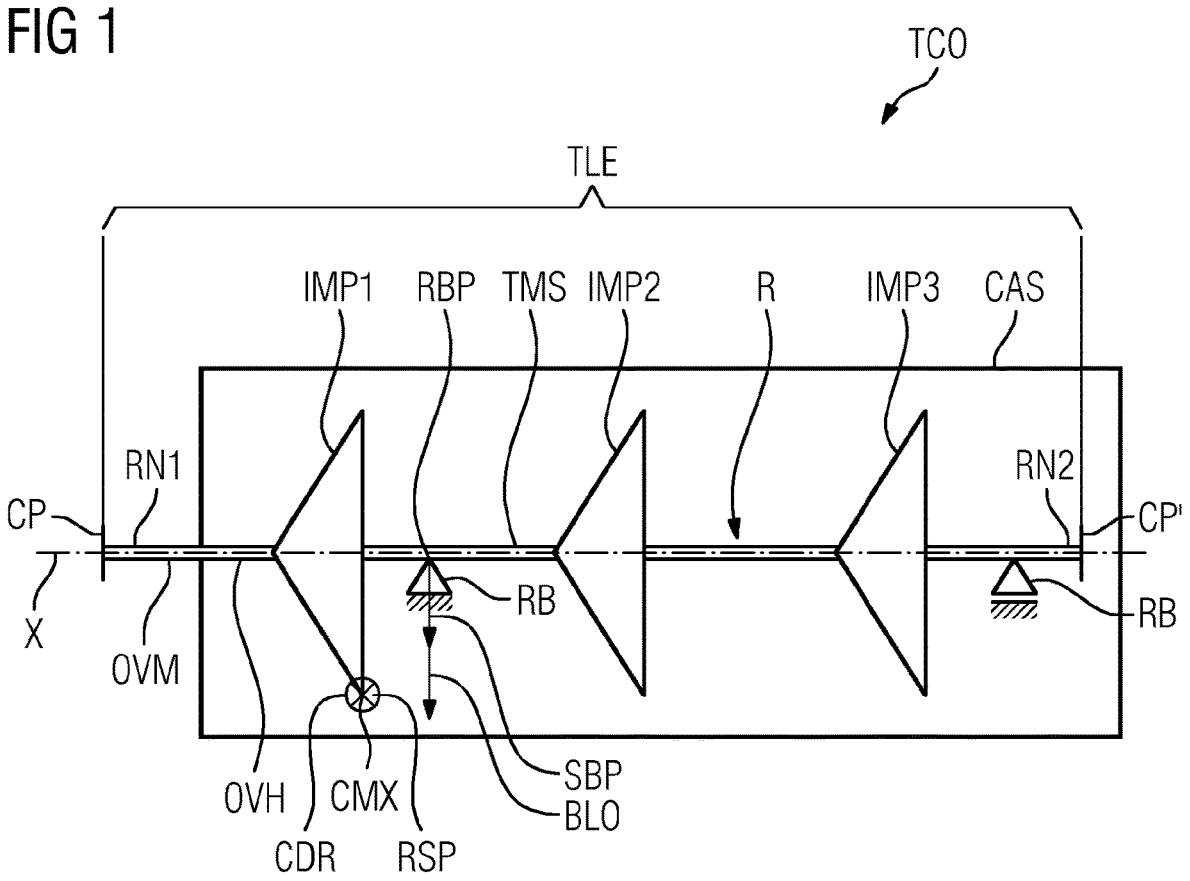
FIG. 1 a diagrammatic, highly simplified depiction of a turbocompressor according to the invention, FIG. 2 a diagrammatic depiction of a cavity according to the invention in longitudinal section, FIG. 3 a diagrammatic depiction of a turbomachine according to the invention with a bend of 1% in the region of the radial bearing of the rotor, FIG. 4 a diagrammatic depiction of the geometric correlations at the radial bearing point in an axial section.

FIG. 1 shows a diagrammatic depiction of a turbomachine according to the invention, namely a turbocompressor TCO. The longitudinal section is shown greatly simplified as a simple line drawing, with a rotor R and a casing CAS which partially surrounds the rotor R. The rotor R in this example carries three rotating impellers, namely a first impeller IMP1, a second impeller IMP2 and a third impeller IMP3.

The terms "right" and "left" are here used solely in relation to the drawings. In fact, the arrangement may also be reversed, so that "left" simply refers to one side and "right" refers to the other or second side of the arrangement.

The rotor R extends along a rotor axis X and is mounted radially by means of two radial bearings RB. The radial bearing RB arranged on the left is configured as a fixed bearing and accordingly has a connected thrust bearing which is not shown in further detail. This radial bearing mounts the rotor R between a first shaft end RN1 and the rest of the rotor R. The radial bearing RB arranged on the right divides the rotor, by means of this radial bearing point, into a second shaft end RN2 and the rest of the rotor R. The radial bearing point RBP of the left-side radial bearing RB is arranged to the right of the first impeller IMP1, so that the first impeller IMP1 forms an overhang and accordingly is configured as part of an overhang OVH of the rotor R. A coupling CP is arranged at the end of the first shaft end RN1 for coupling to other rotation machines, for example a drive. Alternatively, a coupling CP' (here shown as an option) may also be provided at the second shaft end RN2. The rotor R has a total length TLE and the overhang OVH has an overhang length OVL. The overhang OVH in addition has an overhang mass OVM which stands in a specific ratio to the total mass TMS of the rotor R. As an example, a bearing load BLO is shown on the left radial bearing RB, and a static bearing pressure SBP resulting from the bearing load BLU. The figure also shows, again diagrammatically, the outermost circumference CMX of the rotor R at the first impeller IMP1, at which the maximal circumferential speed RSP in the circumferential direction CDR is achieved in nominal operation.

Figure 2:
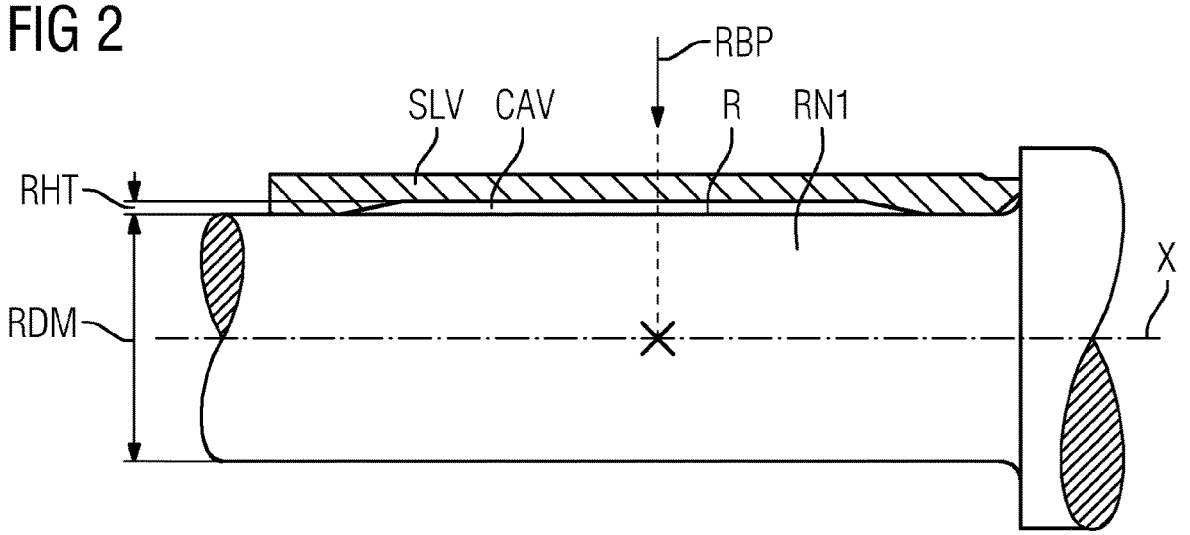

FIG. 2 shows details of the configuration of a thermally insulating cavity at the radial bearing point RBP of the left radial bearing RB in FIG. 1. The cavity CAV is here formed by means of the sleeve SLV which is shrunk onto the first shaft end RN1 in the region of the radial bearing point RBP. A radial recess with radial height RHT is arranged between two shrink-fit seats of the sleeve SLV, axially on the radial inside of the sleeve SLV. The rotor R has a rotor diameter RDM in the region of the radial bearing point RBP, wherein the radial height RHT of the cavity is less than 10%, advantageously less than 5% of the rotor diameter RDM. In this way, the desired thermally insulating effect is achieved.

Figure 3:
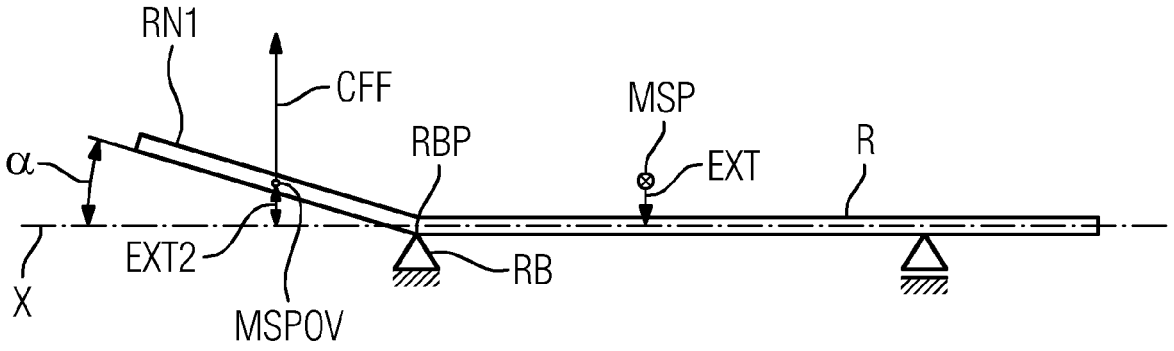

FIG. 3 shows diagrammatically a bend of the first shaft end RN1 about an angle $\alpha$ in the region of the radial bearing point RBP, so that the center of gravity MSPOV of the overhang OV (as distinct from the center of gravity MSP of the total rotor R and the eccentricity EXT of the center of gravity MSP from the rotor axis X) shifts eccentrically by an eccentricity EXT2. As a result of the eccentricity of the first shaft end RN1, a centrifugal force CFF is created because of the resulting imbalance.

In FIGS. 1 and 3, the first shaft end RN1 of the rotor R protrudes from the axial center of the radial bearing point RBP by the overhang OVH over the radial bearing point RBP, wherein a first quotient QLO of the overhang OVH to a total length TLE of the rotor R is QLO=OVH/TLE>0.15.

The axial extent of the overhang OVH of the rotor R has an overhang mass OVM and the complete rotor R has a total mass TMS, wherein a second quotient QOT of the overhang mass OVM to the total mass TMS is QOT=OVM/TMS>0.06.

The radial bearing RB is configured such that a static bearing pressure SBP is >6 bar.

The turbomachine is configured for a nominal operating state with a circumferential speed RSP of RSP>60 m/s at the outermost circumference CMX of the rotor R. The radial bearing RB is configured for an isentropic mounting. The protruding first shaft end RN1 has a coupling CP, wherein the mass of the coupling CP is at least 2% of the total mass TMS of the rotor R.

The weight force of the overhang mass OVM is at least 12% of the bearing load BLO of the radial bearing RB.

The overhang has a center of gravity, wherein the center of gravity of the overhang is closer to the axial end of the rotor R than to the axial center point of the radial bearing RB.

The rotor R is designed for nominal operation such that, at nominal rotation speed NN, an imbalance centrifugal force of the overhang at a 1° bend in the radial bearing RB amounts to at least 60% of the static bearing force in the radial bearing RB.

In FIG. 2, a radial height RHT of the cavity CAV is less than 10%, advantageously less than 5% of the rotor diameter RDM at the radial bearing position RBP.

The bearing RB has a relative eccentricity EXT of EXT<0.1.

Figure 4:
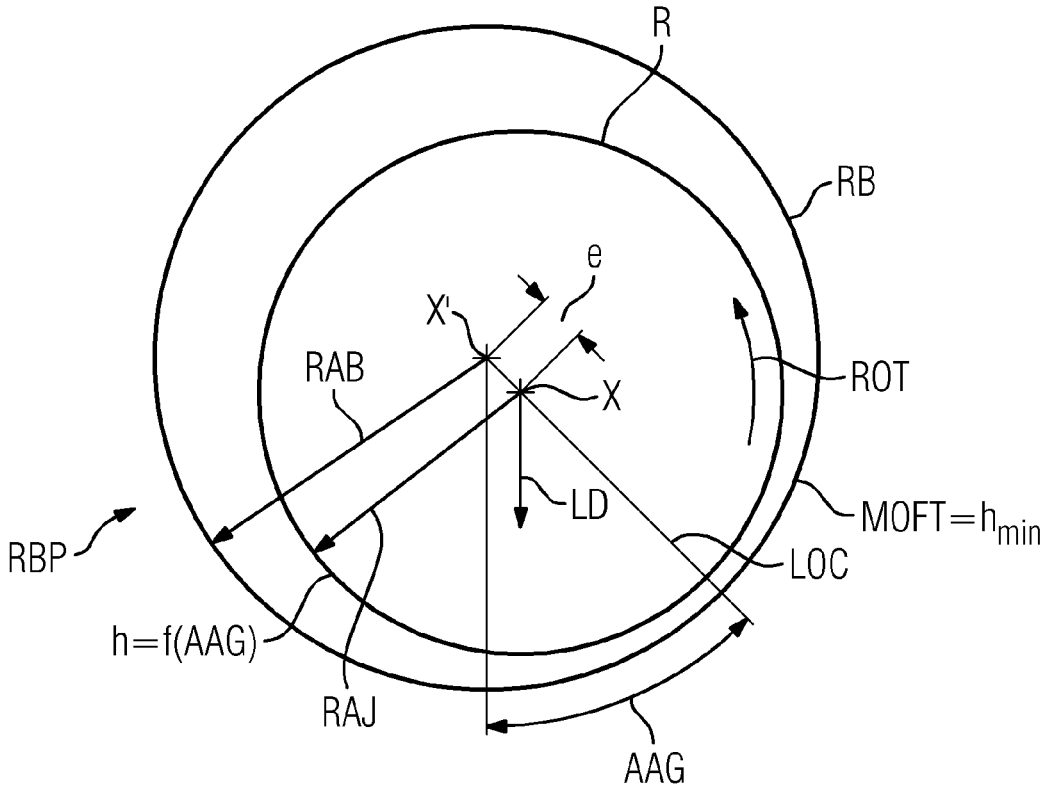

FIG. 4 shows a diagrammatic, axial sectional depiction of the rotor R or the shaft of the rotor R in the region of the left thrust bearing RB. In FIG. 4, the rotor R is shown in a rotation ROT against the stationary radial bearing RB. The rotor R extends axially in the direction of the rotor axis X. The radial bearing RB has a radial center point X'. The illustration in FIG. 4 shows a specific axial section indicating geometric parameters which are averaged over the length of the radial bearing RB in the axial direction. With regard to the inner surface of the slide faces, the radial bearing RB has a radial bearing radius RAB. The rotor R has a radius RAJ. The radius of the rotor RAJ is smaller than the radius of the bearing RAB. Because of the rotation ROT, the rotor R is positioned in a specific radial position in the radial bearing RB. In this radial position, the rotational axis X and the radial center point X' of the radial bearing RB lie on an axis of the axes LOC. In extension of the axis of the axes LOC, in this operating state there is a minimal radial play between the surface of the rotor R and the slide face of the radial bearing RB. The minimal radial play HMIN is here also designated OFT. In general, the radial play between the surface of the rotor R and the slide face of the radial bearing RB is designated H, with a function of the circumferential position AAG (here indicated as an angle). The distance between the rotor axis X and the radial center X' of the radial bearing RB is the eccentricity E. From this, in combination with the theoretical radial play (difference between radius of bearing RAB and radius of rotor RAJ), the relative eccentricity is determined.

The invention claimed is:

1. A turbomachine, comprising:

a rotor which is at least partly arranged in a casing and extends along a rotational axis, at least one radial bearing in which the rotor is radially mounted at a radial bearing point, wherein the at least one radial bearing is designed as an oil-lubricated slide bearing, wherein in an axial region of the radial bearing point, the rotor has a cavity which is annularly located in a circumferential direction in a region of an outer 20% of a diameter of the radial bearing point of the rotor and which provides thermal insulation between a radially inner core region of the rotor in the region of the radial bearing point and a radially outer region of the rotor in the region of the radial bearing point, wherein a first shaft end of the rotor protrudes from an axial center of the radial bearing point by an overhang OVH over the radial bearing point, wherein a first quotient QLO of the overhang OVH to a total length TLE of the rotor is QLO=OVH/TLE>0.15, and wherein a radial height of the cavity is less than 10% of the rotor diameter at the radial bearing position.

2. The turbomachine as claimed in claim 1, wherein an axial extent of the overhang OVH of the rotor has an overhang mass OVM, and the complete rotor has a total mass TMS, wherein a second quotient QOT of the overhang mass OVM to the total mass TMS is QOT=OVM/TMS>0.06.

3. The turbomachine as claimed in claim 1, wherein the radial bearing is configured such that a static bearing pressure >6 bar.

4. The turbomachine as claimed in claim 1, wherein the rotor has an eccentricity <0.1.

5. The turbomachine as claimed in claim 1, wherein the turbomachine is configured for a nominal operating state with a circumferential speed >60 m/s at the outermost circumference of the rotor.

6. The turbomachine as claimed in claim 1, wherein the radial bearing is configured for an isentropic mounting.

7. The turbomachine as claimed in claim 1, wherein the protruding first shaft end has a coupling, wherein a mass of the coupling is at least 2% of a total mass TMS of the rotor.

8. The turbomachine as claimed in claim 1, wherein a weight force of an overhang mass OVM is at least 12% of the bearing load of the radial bearing.

9. The turbomachine as claimed in claim 1, wherein the overhang OVH has a center of gravity, wherein the center of gravity of the overhang OVH is situated closer to the axial end of the rotor than to the axial center point of the radial bearing.

10. The turbomachine as claimed in claim 1, wherein the rotor is configured for nominal operation such that, at nominal rotation speed, an imbalance centrifugal force of the overhang OVH at 1° bend on the radial bearing amounts to at least 60% of a static bearing force in the radial bearing.

11. The turbomachine as claimed in claim 1, wherein a radial height of the cavity is less than 5% of the rotor diameter at the radial bearing position.

12. The turbomachine as claimed in claim 1, wherein the turbomachine comprises a turbocompressor.

* * * * *